US007909144B2

(12) United States Patent
Fukui et al.

(10) Patent No.: US 7,909,144 B2
(45) Date of Patent: Mar. 22, 2011

(54) CAR OSCILLATION DETECTING DEVICE FOR ELEVATOR USING A SET VALUE TO JUDGE CAR OSCILLATION

(75) Inventors: Daiki Fukui, Tokyo (JP); Kenichi Okamoto, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 744 days.

(21) Appl. No.: 11/909,377

(22) PCT Filed: Aug. 10, 2005

(86) PCT No.: PCT/JP2005/014676

§ 371 (c)(1),
(2), (4) Date: Sep. 21, 2007

(87) PCT Pub. No.: WO2006/100791

PCT Pub. Date: Sep. 28, 2006

(65) Prior Publication Data

US 2010/0140023 A1 Jun. 10, 2010

(30) Foreign Application Priority Data

Mar. 22, 2005 (WO) ..... PCT/JP2005/005092

(51) Int. Cl.
*B66B 1/34* (2006.01)

(52) U.S. Cl. ..... 187/393; 187/292

(58) Field of Classification Search ..... 187/277, 187/278, 292, 391–394
See application file for complete search history.

(56) References Cited

U.S. PATENT DOCUMENTS

| | | | | |
|---|---|---|---|---|
| 4,271,931 | A * | 6/1981 | Watanabe | 187/292 |
| 5,289,902 | A * | 3/1994 | Fujita | 187/346 |
| 5,959,266 | A * | 9/1999 | Uchiumi | 187/292 |
| 6,089,355 | A * | 7/2000 | Seki et al. | 187/292 |
| 7,484,598 | B2 * | 2/2009 | Tyni et al. | 187/393 |
| 2002/0046906 | A1 * | 4/2002 | Grundmann | 187/292 |
| 2004/0020725 | A1 * | 2/2004 | Utsunomiya et al. | 187/292 |

FOREIGN PATENT DOCUMENTS

| | | |
|---|---|---|
| DE | 103 34 561 A1 | 2/2004 |
| EP | 0 847 954 | 6/1998 |
| JP | 60-2575 | 1/1985 |
| JP | 7-285746 | 10/1995 |
| JP | 8-333068 | 12/1996 |
| JP | 9-2752 | 1/1997 |
| JP | 9-202560 | 8/1997 |
| JP | 11-79594 | 3/1999 |
| JP | 2000-128452 | 5/2000 |
| JP | 2003-267636 | 9/2003 |
| KR | 2003-0092115 | 12/2003 |

* cited by examiner

*Primary Examiner* — Jonathan Salata
(74) *Attorney, Agent, or Firm* — Oblon, Spivak, McClelland, Maier & Neustadt, L.L.P.

(57) ABSTRACT

Since the elevator type is varied, a set value used for judging car oscillation must be set for each elevator, which requires much time and labor. Also, if the criteria of all elevators are represented by one set value to eliminate the time and labor required for the setting, variations in detection occur. A car oscillation detecting device includes a means in which a set value, which is used as a criterion for judging car oscillation, is stored in advance as a table or a relational expression in which an elevator specification is used as a parameter, and the set value is selected automatically by using the information of the elevator specification, by which the time and the labor for setting are eliminated. Further, since the set value is a value suitable for that elevator, variations in detection can be restrained, and hence the reliability is high.

10 Claims, 8 Drawing Sheets

| TRAVEL [m] / CAPACITY [kg] | 5~10 | 10~20 | |
|---|---|---|---|
| 600 | $A_{11} \cdot H + B_{11}$ | $A_{12} \cdot H + B_{12}$ | |
| 900 | $A_{21} \cdot H + B_{21}$ | $A_{22} \cdot H + B_{22}$ | |
| | | | |

H: TRAVEL
A, B: RELATED COEFFICIENT

CAR OSCILLATION DETECTING DEVICE FOR ELEVATOR USING A SET VALUE TO JUDGE CAR OSCILLATION

TECHNICAL FIELD

The present invention relates to a car oscillation detecting device for an elevator. More particularly, it relates to a car oscillation detecting device that restrains forced oscillation caused by mischief of a passenger in a car to prevent a safety device of the elevator from being operated by the forced oscillation.

BACKGROUND ART

Generally, if an elevator car is subjected to forced oscillation caused by mischief of a passenger, and the oscillation becomes remarkable, a safety device is operated, which leads to an accident such that passengers are shut up into the car.

Conventionally, there has been known a car oscillation alai device of an elevator, in which in order to prevent the shut-up accident by detecting a relatively small oscillation of a car before the oscillation becomes large, an oscillation detecting body for detecting vertical oscillation of the car not less than a set value and an alarm means that generates an alarm based on the output of the oscillation detecting body are provided to give attention to the passengers (for example, Patent Document 1).

Patent Document 1: Japanese Patent Laid-Open No. 9-202560

DISCLOSURE OF THE INVENTION

Problems to be Solved by the Invention

However, for the conventional car oscillation alarm device, in the case where the travel or capacity of elevator changes, the set value used for the detection and judgment of car oscillation must be changed each time. Generally, the travel and capacity of elevator are different depending on the building, so that the mechanical characteristics thereof also differ. For example, the level of vibration produced by the forced oscillation caused by one grown-up person becomes higher or lower depending on the change of travel and capacity. As a result, the set value used for the judgment of car oscillation must be set for each elevator, which poses a problem in that much time and labor are required. Further, if the criteria of all elevators are represented by one set value to eliminate the time and labor required for the setting, misdetection occurs frequently for the elevator type in which vibrations easily become large, and the car oscillation detection does not function although the car is in a dangerous condition for the elevator type in which vibrations are difficult to become large. Thus, there arises a problem in that variations in detection occur.

The present invention has been made to solve the above problems, and accordingly an object thereof is to provide a car oscillation detecting device for an elevator, which can be used for varied types of elevators.

Means for Solving the Problems

The present invention provides a car oscillation detecting device for an elevator, including a vibration detecting means for detecting vibrations produced in a car; a set value reading means in which a set value, which is used as a criterion for judging car oscillation, is stored in advance as a table or a relational expression in which an elevator specification that exerts an influence on the mechanical characteristics of elevator at the time of car oscillation is used as a parameter, and the set value is selected automatically by using the information of the elevator specification; and a car oscillation detecting device for judging car oscillation by comparing the detection value of the vibration detecting means with the selected set value of the set value reading means.

Also, the present invention provides a car oscillation detecting device for an elevator, including a vibration detecting means for detecting vibrations produced in a car; a load weighing device for detecting the number of passengers in the car; a set value reading means in which a set value, which is used as a criterion for judging car oscillation, is stored in advance as a table or a relational expression in which elevator specification is used as a parameter, and the set value is selected automatically by using the information of the elevator specification, and also the set value is set again according to the number of passengers in the car detected by the load weighing device; and a car oscillation judging device for judging car oscillation by comparing the detection value of the vibration detecting means with the set value selected once and the set value set again according to the number of passengers in the car detected by the load weighing device.

Further, when car oscillation is judged, any one of operation commands of an alarm announcement command, a half-speed operation command, a nearest floor stop command, and an emergency stop command is issued according to the level of the set value.

Advantages of the Invention

According to the present invention, the table of set value in which the travel, capacity, speed, and the like for each elevator are used as parameters is provided in advance. Therefore, a remarkable advantage is realized that even if the mechanical elements such as the travel, capacity, and speed of elevator change, the set value need not be set for each elevator, and moreover, misdetection of car oscillation and variations in detection are reduced.

DESCRIPTION OF SYMBOLS

Figure 1:
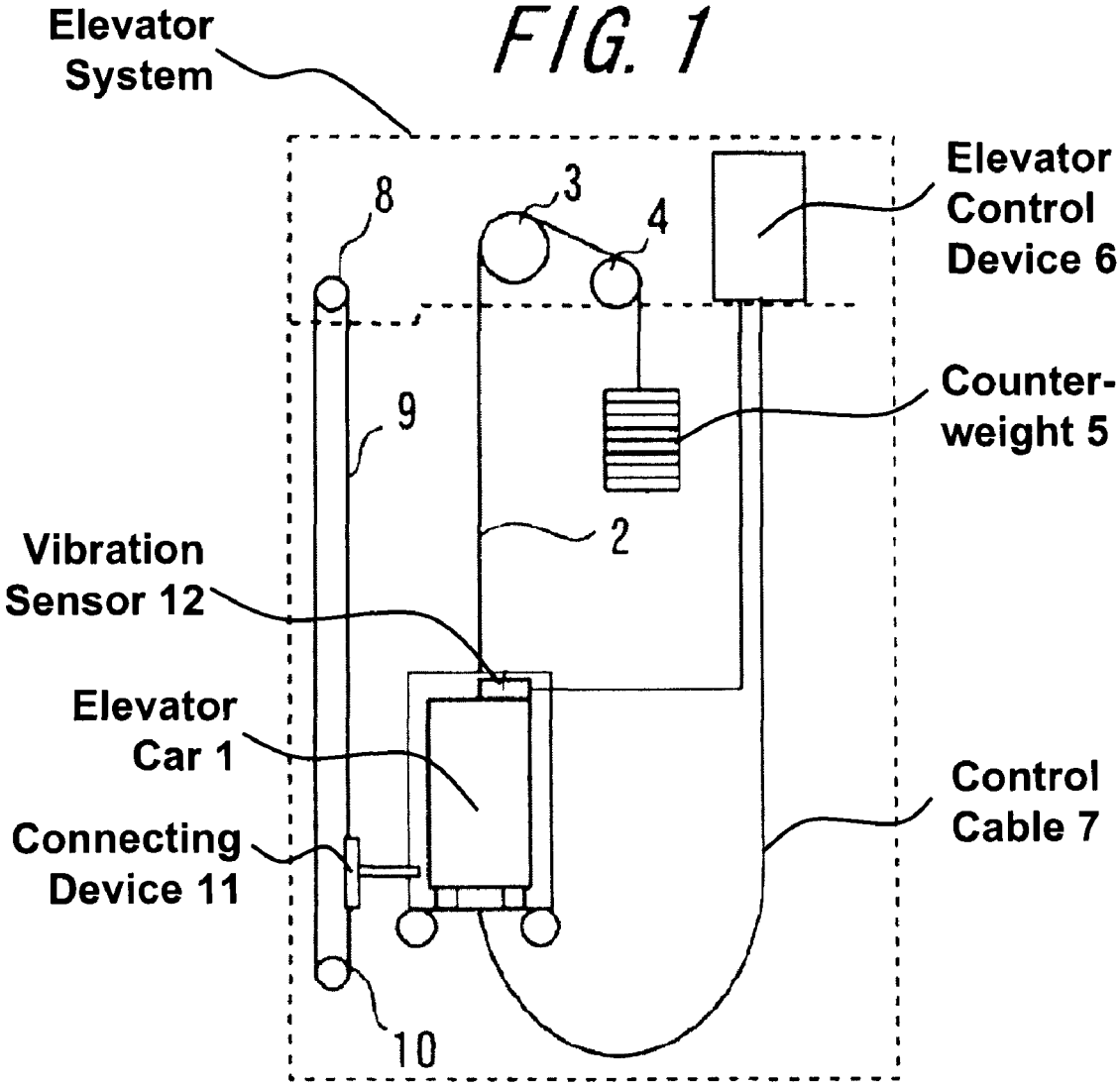
FIG. 1 is a schematic view showing a general configuration of a car oscillation detecting device for an elevator in accordance with embodiment 1 of the present invention.

1 car
2 main rope
3 traction machine
4 deflector sheave
5 counterweight
6 elevator control device
7 control cable
8 governor
9 governor rope
10 governor tension sheave
11 connecting device
12 vibration detecting means (vibration sensor)
13 car oscillation detecting device
14 set value reading device
15 elevator specification storage device
16 set value map storage device
17 car oscillation judging device
18 alarm announcement commanding device
19 half-speed operation commanding device
20 nearest floor stop commanding means
21 emergency stop commanding device
22 load weighing device
23 set value map re-setting device
24 traction machine encoder
25 governor encoder
26 shackle part
27 shackle part vibration sensor

BEST MODE FOR CARRYING OUT THE INVENTION

The present invention will now be described in more detail with reference to the accompanying drawings.

Embodiment 1

FIG. 1 is a schematic view showing a general configuration of a car oscillation detecting device for an elevator in accordance with embodiment 1 of the present invention. An elevator system includes an elevator car 1 that runs along a guide rail in an elevator shaft, and a counterweight 5 that runs in the direction opposite to the car 1 along another guide rail in the elevator shaft, and further includes a main rope 2, an elevator traction machine 3, a deflector sheave 4, an elevator control device 6, a control cable 7, a governor 8, a governor rope 9, a governor tension sheave 10, and a connecting device 11. The car 1 is provided with a vibration sensor 12 serving as a vibration detecting means that generates a voltage signal according to the vibration produced in the car. The governor rope 9 is wound around the governor 8, and the other end side of the governor rope 9 is wound around the governor tension sheave 10 provided in a lower part in the shaft, by which the tension of the governor rope 9 is held. Also, the governor rope 9 is attached to the car 1 by the connecting device 11.

Figure 2:
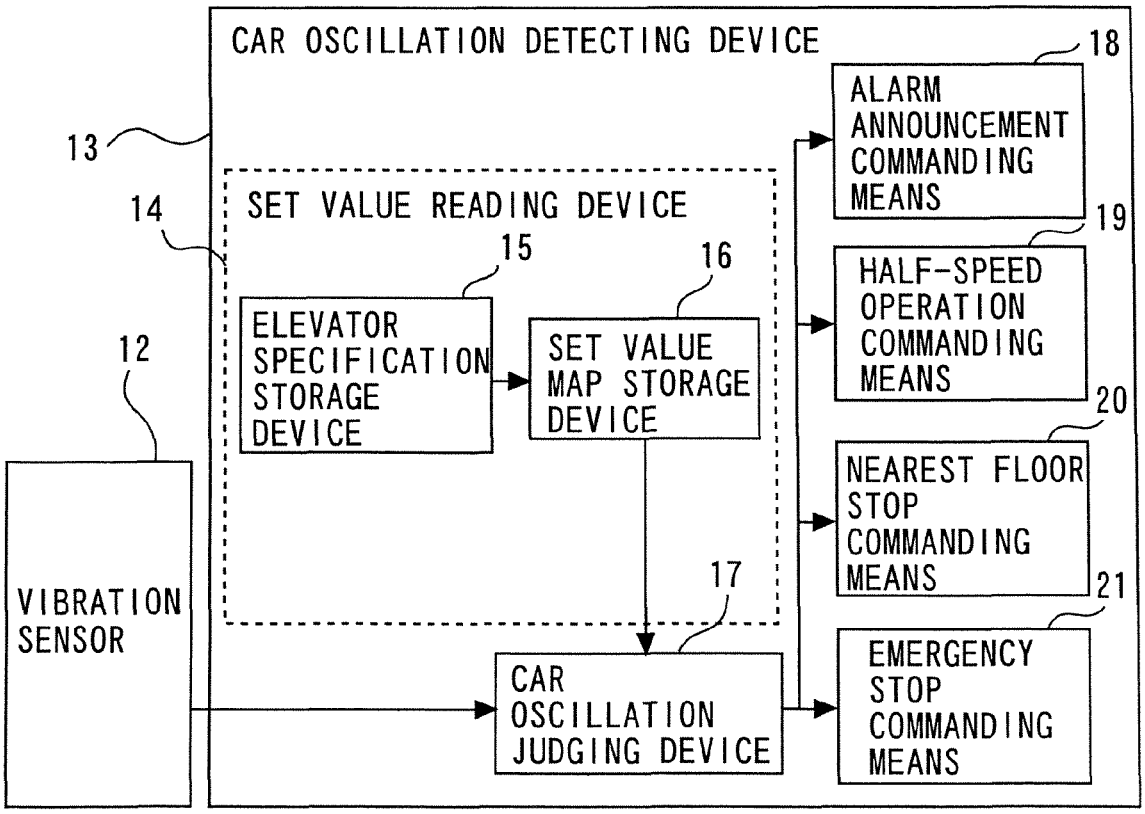
FIG. 2 is a block diagram of a car oscillation detecting device for an elevator in accordance with embodiment 1 of the present invention.

FIG. 2 shows one example of a block diagram showing the configuration of a car oscillation detecting device 13. As shown in FIG. 2, a set value reading device 14 is made up of an elevator specification storage device 15 for storing the travel and capacity of elevator and a set value map storage device 16 for storing a set value, which is used as a criterion for judging car oscillation, for each of specifications of travel and capacity of elevator. First, the information of elevator specifications is sent from the elevator specification storage device 15 to the set value map storage device 16, by which a set value corresponding to that elevator is selected from a set value map, the set value for judging the car oscillation of that elevator is stored in the set value reading device 14, and the stored set value is sent to a car oscillation judging device 17. In the car oscillation judging device 17, a voltage signal is input from the vibration sensor 12 for detecting the car oscillation, and if the input from the sensor 12 is larger than the set value, it is judged that car oscillation has been produced. In the set value map storage device 16, not only the set value but also the number of setting operations is stored, and it may be used as the criterion for judging. Also, the number of set values in not limited to one, and some levels of set values may be prepared. As the operation after the detection of car oscillation, any one of operation commands of alarm announcement in the car, stop at a destination floor or a car call floor by half-speed operation, nearest floor stop, and emergency stop is issued. In FIG. 2, reference numeral 18 denotes an alarm announcement commanding means, 19 denotes a half-speed operation commanding means, 20 denotes a nearest floor stop commanding means, and 21 denotes an emergency stop commanding means. In FIG. 2, the car oscillation detecting device 13 enclosed by a solid line shows an example of the device 13 mounted in the control device 6 for controlling the operation of elevator. However, the car oscillation detecting device 13 may be integrated with the vibration sensor 12, and may be disposed in the car 1. In this case, only the elevator specification storage device 15 is located on the control device 6 side, the information thereof is sent to the car oscillation detecting device 13.

Figures 3, 4:
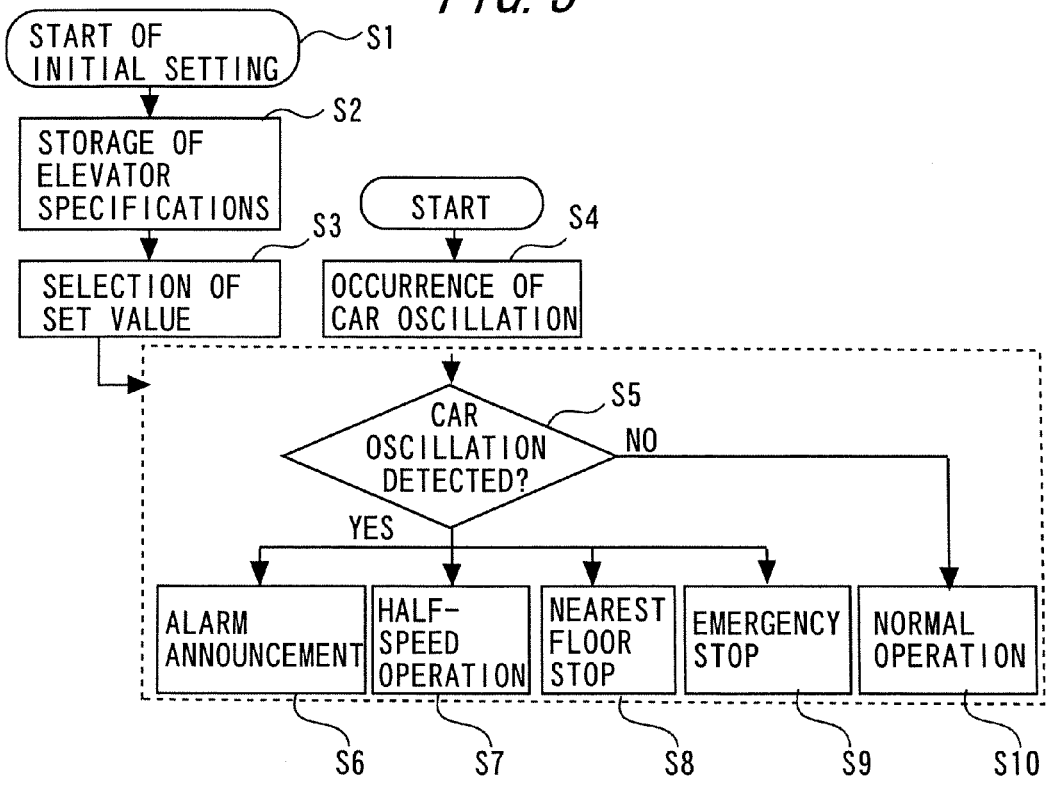
FIG. 3 is a flowchart showing an operation procedure for a car oscillation detecting device for an elevator in accordance with embodiment 1 of the present invention.
FIG. 4 is a chart showing one example of a set value map for a car oscillation detecting device for an elevator in accordance with embodiment 2 of the present invention.

FIG. 3 is a flowchart showing an operation procedure for the car oscillation detecting device for an elevator.

The procedures in Steps S1 to S3 carried out in the set value reading device 14 are carried out when the elevator is installed. Specifically, initial setting is started in Step S1, the elevator specifications such as the travel and capacity of elevator are stored in the elevator specification storage device 15 in Step S2, and a set value corresponding to that elevator is selected from the set value map in Step S3 by sending the information of elevator specifications from the elevator specification storage device 15 to the set value map storage device 16.

Next, during the operation of elevator, the set value that has been selected and set is used. If car oscillation is produced on the car 1 in Step S4, the car oscillation judging device 17 judges, in Step S5, whether or not the input signal from the vibration sensor 12 is larger than the set value. If the input signal is larger than the set value in Step S5, it is judged that car oscillation has been produced, and the control proceeds to alarm announcement (Step S6), half-speed operation (Step S7), nearest floor stop (Step S8), or emergency stop (Step S9). If the input signal is smaller than the set value in Step S5, the control proceeds to Step S10, where the normal operation is performed.

In the case where the elevator specifications etc. are changed, the set value reading device 14 operates by using the same procedures (S1 to S3) as those at the time when the elevator is installed, and the set value is set again, so that the time and labor for setting performed by maintenance personnel can be saved.

According to this configuration, the set value used for car oscillation judgment is automatically set for each elevator, so that the time and labor that have been needed for individual setting in the conventional elevator can be saved. Also, the set value that is set automatically is a value that is set to reliably detect the danger of that elevator. Therefore, if mischief is done in the car, a dangerous condition caused by car oscillation is detected reliably, and thereby malfunction etc. of governor can be prevented.

Embodiment 2

In the set value reading device 14 shown in FIG. 2, the set value map stored in the set value map storage device 16 explained in embodiment 1 may be read in a form of a function in which the specifications of travel and capacity of elevator are used as parameters. FIG. 4 shows one example of relational expression stored in the set value map storage device 16 in the case where the travel is used as a parameter. When the travel and capacity are sent from the elevator specification storage device 15, a function in that specification region is selected, and when the travel is substituted into the function, the set value is calculated. By making division for each elevator specification region and expressing the set value in that region by a function in this manner, a value close to the detection level suitable for that elevator specification can be selected, by which variations in detection can be restrained, and further misdetection can be reduced.

In the example shown in FIG. 4, a mode in which two parameters of travel and capacity is shown. However, in more detailed, the weight of car, the type of traction machine, and the like may be prepared as the parameters for the set value map. Also, the set value map may be set by using the rated speed as a parameter and considering a margin until the operation of governor.

Embodiment 3

Figure 5:
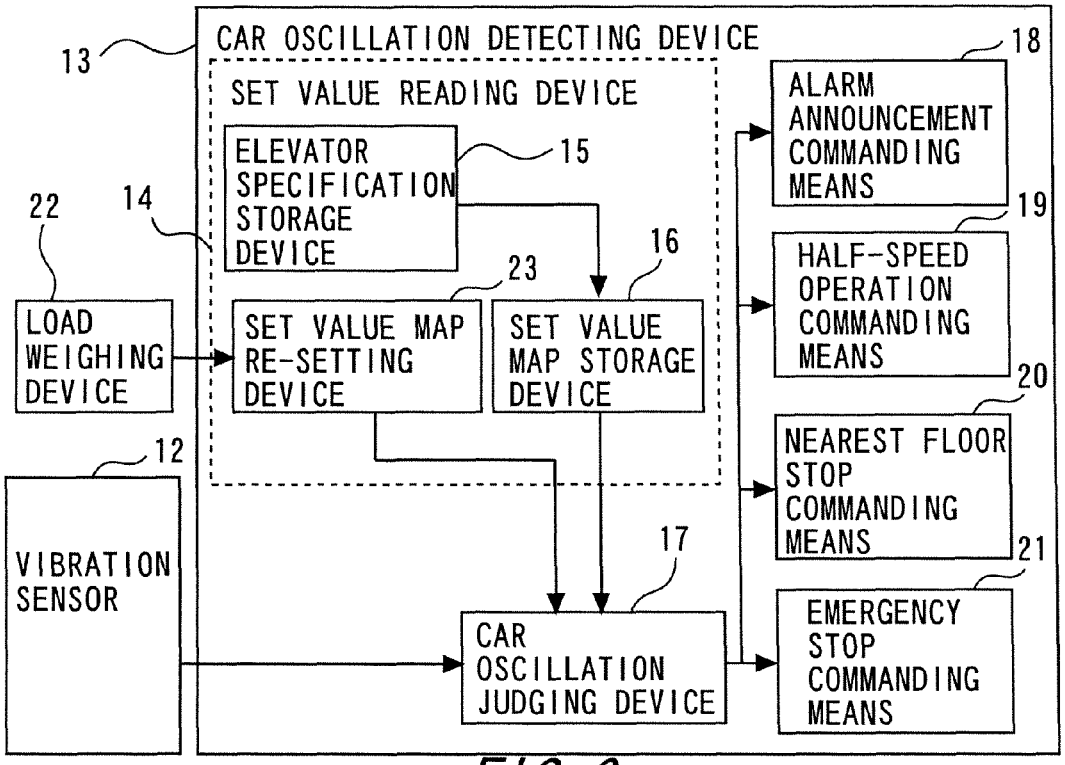
FIG. 5 is a block diagram of a car oscillation detecting device for an elevator in accordance with embodiment 3 of the present invention.

FIG. 5 is a block diagram of a car oscillation detecting device for an elevator in accordance with embodiment 3 of the present invention.

In embodiment 1, the set value is set once when the elevator is installed, and the set value is not set again unless the specification etc. are changed. However, since the weight of elevator car changes due to the number of passengers in the car, the vibration level caused by car oscillation also changes. In embodiment 3, therefore, as shown in FIG. 5, a load weighing device 22 and a set value map re-setting device 23 are further added to the car oscillation detecting device 13 in embodiment 1. The set value that is set once when the elevator is installed is set again according to the number of passengers in the car, and a detection level suitable for the condition of elevator is selected. The number of passengers in the car is measured and detected by using the load weighing device 22. Into the set value map re-setting device 23, a relational expression in which the number of passengers in the car or the boarding weight is used as a parameter is read at the same time that the set value map having been set initially is selected.

Figure 6:
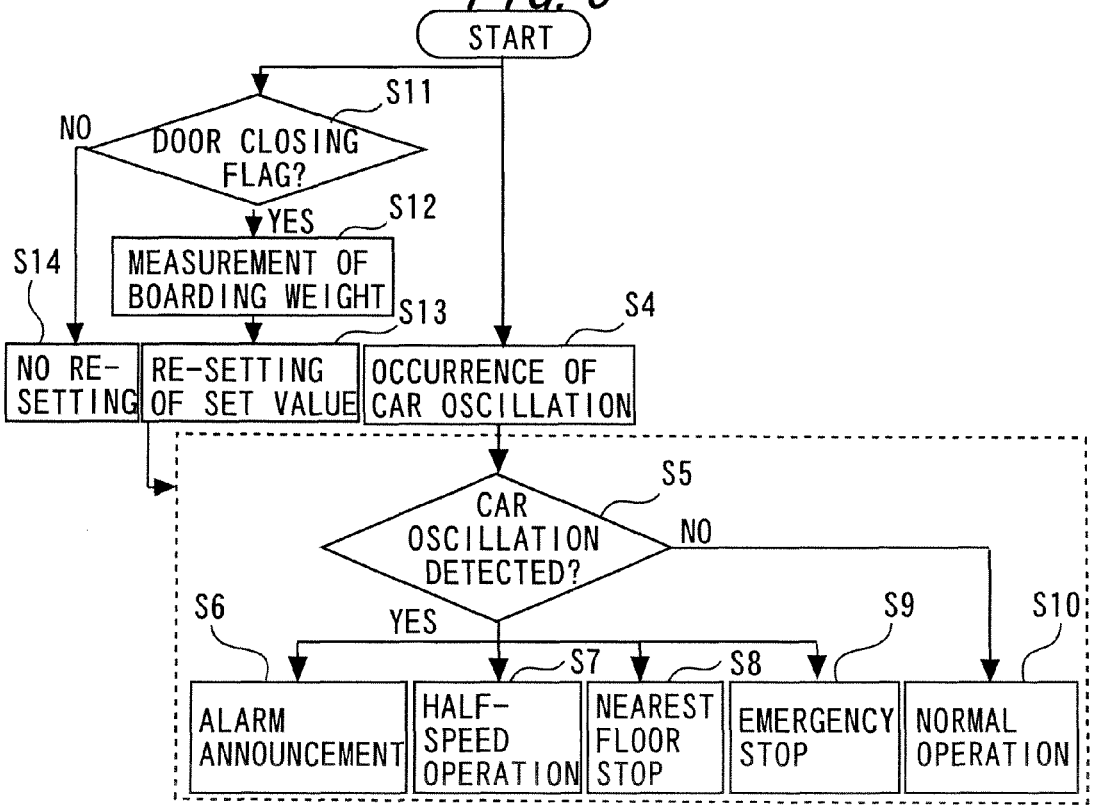
FIG. 6 is a flowchart showing an operation procedure for a car oscillation detecting device for an elevator in accordance with embodiment 3 of the present invention.

FIG. 6 is a flowchart showing an operation procedure for re-setting the car oscillation detecting device for an elevator.

In the procedures in Steps S11 to S14 carried out by the set value reading device 14, a task for re-setting the set value is performed once when the elevator door is closed and the number of passengers in the car is decided, and the set value is changed to a value matching the number of passengers in the car. Specifically, if an elevator door closing flag is judged in Step S11, the number of passengers in the car is measured by the load weighing device 22 in Step S12, and the set value that is set once when the elevator is installed is set again based on the number of passengers in the car in Step S13. If the elevator door closing flag is not judged in Step S11, the control proceeds to Step S14, and the set value is not set again.

When the set value is re-set once, the re-setting is not performed during the time when the door is closed, and the same set value is used until the door is opened next and the door is closed again.

Next, during the operation of elevator, the set value that is set again is used. If car oscillation is produced on the car 1 in Step S4, the car oscillation judging device 17 judges, in Step S5, whether or not the input signal from the vibration sensor 12 is larger than the set value. If the input signal is larger than the set value in Step S5, it is judged that car oscillation has been produced, and the control proceeds to alarm announcement (Step S6), half-speed operation (Step S7), nearest floor stop (Step S8), or emergency stop (Step S9). If the input signal is smaller than the set value in Step S5, the control proceeds to Step S10, where the normal operation is performed.

Embodiment 4

Figure 7:
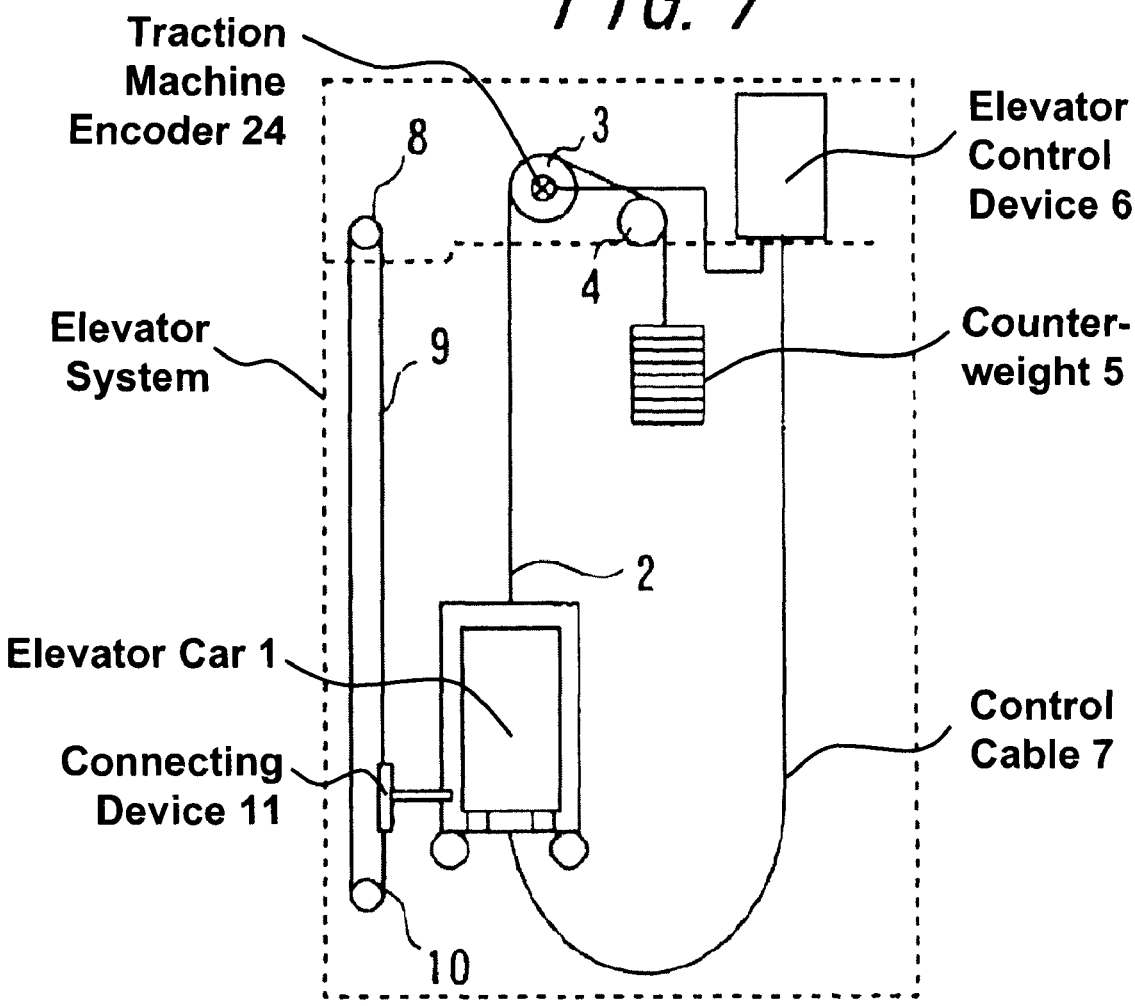
FIG. 7 is a schematic view showing a general configuration of a car oscillation detecting device for an elevator in accordance with embodiment 4 of the present invention.

FIG. 7 is a schematic view showing a general configuration of a car oscillation detecting device for an elevator in accordance with embodiment 4 of the present invention.

In embodiment 1 shown in FIG. 1, the vibration sensor 12 is attached to the car 1. In embodiment 4, however, as shown in FIG. 7, a traction machine encoder 24 provided on the traction machine 3 may be used as a vibration sensor for detecting the oscillation of the car 1.

Embodiment 5

Figure 8:
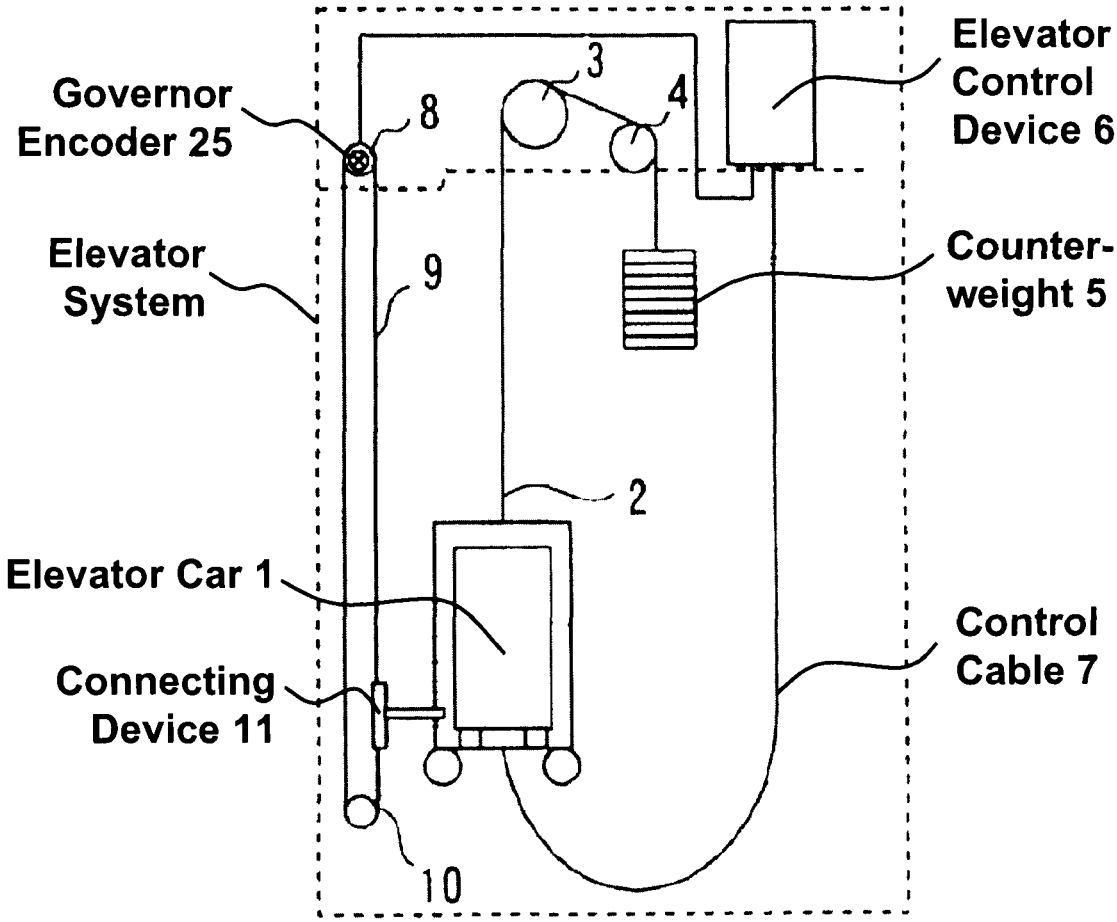
FIG. 8 is a schematic view showing a general configuration of a car oscillation detecting device for an elevator in accordance with embodiment 5 of the present invention.

FIG. 8 is a schematic view showing a general configuration of a car oscillation detecting device for an elevator in accordance with embodiment 5 of the present invention.

In embodiment 5, as shown in FIG. 8, a governor encoder 25 provided on the governor 8 may be used as a vibration sensor for detecting the oscillation of the car 1.

Embodiment 6

Figure 9:
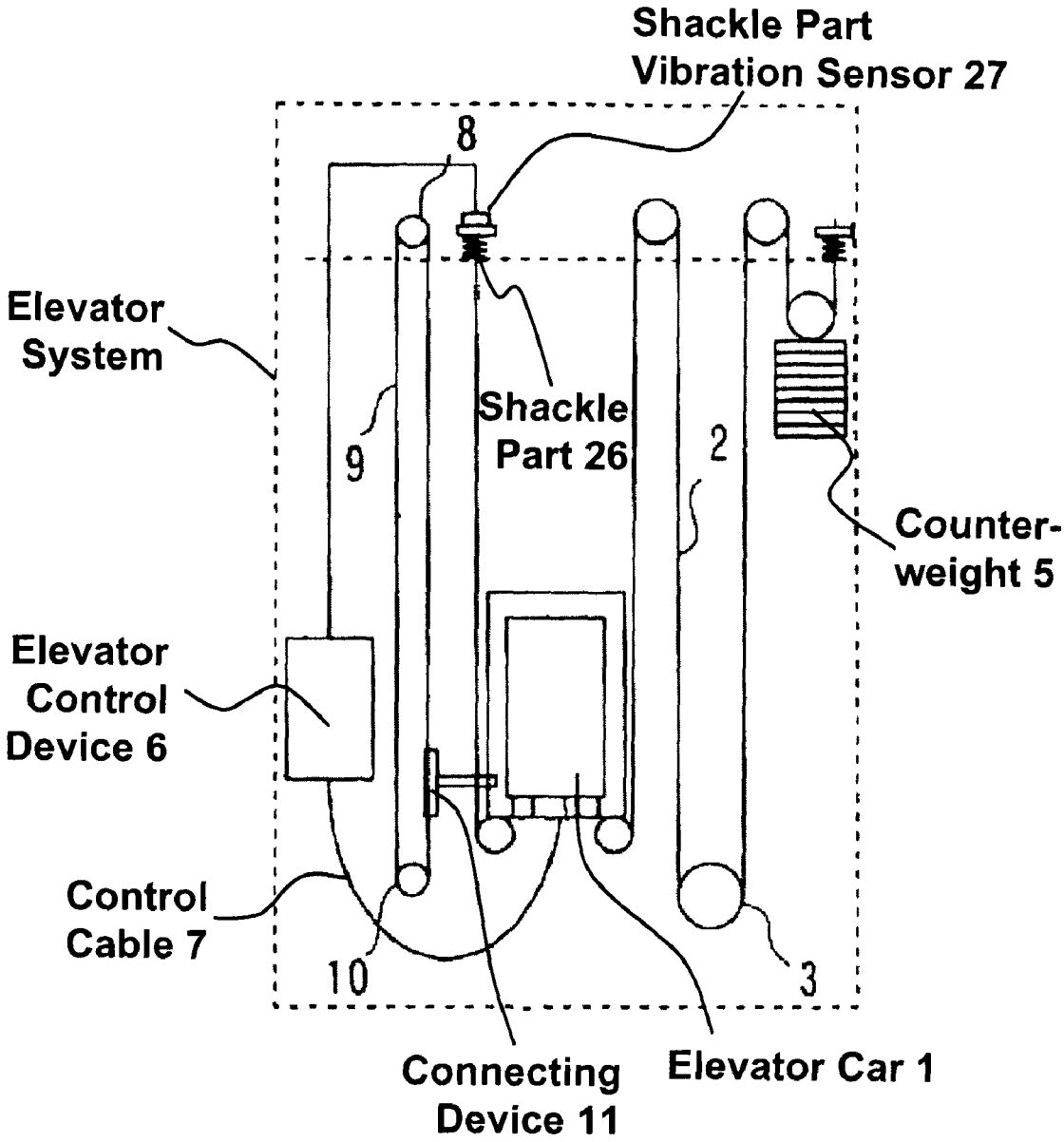
FIG. 9 is a schematic view showing a general configuration of a car oscillation detecting device for an elevator in accordance with embodiment 6 of the present invention.

FIG. 9 is a schematic view showing a general configuration of a car oscillation detecting device for an elevator in accordance with embodiment 6 of the present invention.

In embodiment 6, as shown in FIG. 9, in an elevator system having a rope ratio of 2 to 1, a shackle part vibration sensor 27 for detecting the oscillation of the car 1 may be attached to a shackle part 26 at the car hitch end. In embodiment 6, the shackle part vibration sensor 27 is newly provided. However, the output of the load weighing sensor for measuring the weight of passengers may be used.

Embodiment 7

Figure 10:
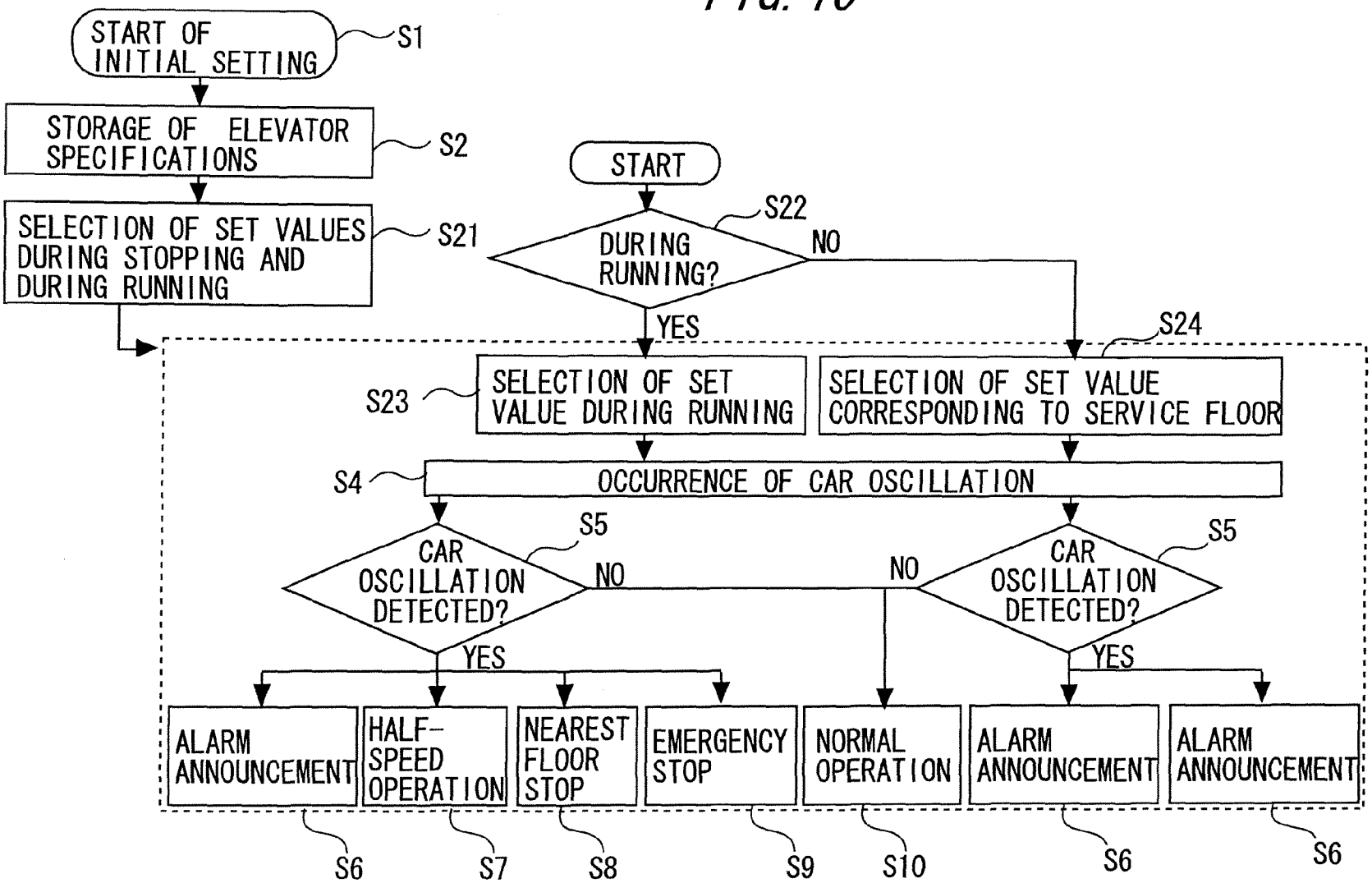
FIG. 10 is a flowchart showing an operation procedure for a car oscillation detecting device for an elevator in accordance with embodiment 7 of the present invention.

FIG. 10 is a flowchart showing an operation procedure for a car oscillation detecting device for an elevator in accordance with embodiment 7 of the present invention.

In embodiment 7, the set value during elevator running and the set value during elevator stopping are prepared in the map stored in the set value map storage device 16 explained in embodiment 1, and these set values are selected according to the elevator specification. The selected set value is selected so as to match the elevator operating condition. The set value during elevator stopping is selected for each elevator service floor.

The procedures in Steps S1, S2 and S21 carried out in the set value reading device 14 are carried out when the elevator is installed. Specifically, initial setting is started in Step S1, the elevator specifications such as the travel and capacity of elevator are stored in the elevator specification storage device 15 in Step S2, and the information of elevator specifications is sent from the elevator specification storage device 15 to the set value map storage device 16 in Step S21, by which the set values during elevator running and during elevator stopping are selected from the set value map.

Next, the set value that has been selected and set according to the elevator operating condition is used. In Step S22, it is judged whether the elevator is running or stopping. If the elevator is running, the set value during elevator running is selected in Step S23, and if car oscillation is produced on the car 1 in Step S4, the car oscillation judging device 17 judges, in Step S5, whether or not the input signal from the vibration sensor 12 is larger than the set value. If the input signal is larger than the set value in Step S5, it is judged that car oscillation has been produced, and the control proceeds to alarm announcement (Step S6), half-speed operation (Step S7), nearest floor stop (Step S8), or emergency stop (Step S9). If the input signal is smaller than the set value in Step S5, the control proceeds to Step S10, where the normal operation is performed.

If the elevator is stopping, the set value corresponding to the service floor is selected in Step S24, and if car oscillation is produced on the car 1 in Step S4, the car oscillation judging device 17 judges, in Step S5, whether or not the input signal from the vibration sensor 12 is larger than the set value. If the input signal is larger than the set value in Step S5, it is judged that car oscillation has been produced, and alarm announcement (Step S6) is made. In the case where the oscillation is not stopped even if the announcement is made, the operation is suspended for a while, and when the oscillation dies down and the input signal becomes not larger than the set value, the operation is restarted. Also, if the input signal is smaller than the set value in Step S5, the control proceeds to Step S10, where the normal operation is performed.

According to this configuration, the set value suitable for the elevator in which the vibration characteristics change according to the operating condition such as running or stopping can be set not depending on the elevator operating condition. Also, the set value that is set automatically is a value that is set to reliably detect the danger of that elevator. Therefore, if mischief is done in the car, a dangerous condition caused by car oscillation is detected reliably, and thereby the safety of passengers and equipment can be ensured.

INDUSTRIAL APPLICABILITY

As described above, in the car oscillation detecting device in accordance with the present invention, the table of set values in which the elevator specifications are used as parameters is set in advance. Thereby, even if the elevator specifications of travel and capacity change, the set value need not be set for each elevator. Also, since the set value suitable for an individual elevator is selected, misdetection is reduced, and hence the reliability can be increased.

The invention claimed is:

1. A car oscillation detecting device for an elevator, comprising:

vibration detecting means for detecting vibrations produced in a car;

set value storing means for storing in advance a plurality of set values, which are used as criteria for judging car oscillation, as a table or a relational expression in which an elevator specification that exerts an influence on the mechanical characteristics of elevator at a time of car oscillation is used as a parameter;

set value selecting means for automatically selecting a set value from the plurality of set values by using information of the elevator specification; and car oscillation judging means for judging car oscillation by comparing a detection value of the vibration detecting means with the selected set value of the set value storing means.

2. The car oscillation detecting device for an elevator according to claim 1, further comprising:

load weighing means for detecting a number of passengers in the car; and set value reading means for setting the set value, which is used as a criterion for judging car oscillation, according to the number of passengers in the car or a boarding weight detected by the load weighing means.

3. The car oscillation detecting device for an elevator according to claim 1, wherein the set value storing means includes, elevator specification storage means for storing a travel and capacity of the elevator, and set value map storage means for storing the set value for each specification of travel and capacity of the elevator.

4. The car oscillation detecting device for an elevator according to claim 3, wherein as a parameter of a set value map, a weight of the car and a type of traction machine are prepared.

5. The car oscillation detecting device for an elevator according to claim 1, wherein the vibration detecting means is provided on any one of the car, a traction machine encoder, a governor encoder, or a shackle part at a hitch end of the car.

6. The car oscillation detecting device for an elevator according to claim 2, wherein the vibration detecting means is provided on any one of the car, a traction machine encoder, a governor encoder, or a shackle part at a hitch end of the car.

7. The car oscillation detecting device for an elevator according to claim 1, wherein when car oscillation is judged, any one of operation commands of an alarm announcement command, a half-speed operation command, a nearest floor stop command, or an emergency stop command is issued according to a level of the set value.

8. The car oscillation detecting device for an elevator according to claim 2, wherein when car oscillation is judged, any one of operation commands of an alarm announcement command, a half-speed operation command, a nearest floor stop command, or an emergency stop command is issued according to a level of the set value.

9. The car oscillation detecting device for an elevator according to claim 3, wherein the set value map storage means includes means for properly setting the set value, which is used as a criterion for judging car oscillation, so as to match an operating condition of elevator.

10. The car oscillation detecting device for an elevator according to claim 9, wherein as the set value, which is used as a criterion for judging car oscillation, a set value during elevator running and a set value during elevator stopping are prepared.

* * * * *